US007277093B2

(12) United States Patent
Kim

(10) Patent No.: US 7,277,093 B2
(45) Date of Patent: Oct. 2, 2007

(54) LOW POWER APPARATUS USED WITH A DISPLAY DEVICE

(75) Inventor: Gi-soo Kim, Incheon Metropolitan (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 212 days.

(21) Appl. No.: 10/361,637

(22) Filed: Feb. 11, 2003

(65) Prior Publication Data

US 2004/0061696 A1 Apr. 1, 2004

(30) Foreign Application Priority Data

Sep. 13, 2002 (KR) ..... 2002-0055645

(51) Int. Cl.
*G09G 5/00* (2006.01)

(52) U.S. Cl. ..... 345/211; 345/211; 345/212; 345/213; 345/204; 713/300; 348/730

(58) Field of Classification Search ..... 345/211–214, 345/201, 87, 204, 300, 320, 324; 713/300, 713/320, 324
See application file for complete search history.

(56) References Cited

U.S. PATENT DOCUMENTS 5,736,873 A * 4/1998 Hwang ..... 327/41
6,006,335 A * 12/1999 Choi et al. ..... 713/310
6,085,326 A * 7/2000 Kim ..... 713/300
6,275,221 B1 * 8/2001 Song ..... 345/211
6,404,423 B1 * 6/2002 Kivela et al. ..... 345/212
6,515,655 B1 * 2/2003 Thornblad ..... 345/211
6,844,867 B2 * 1/2005 Yamada ..... 345/99

FOREIGN PATENT DOCUMENTS

KR 10-10972 A 2/2001

* cited by examiner

*Primary Examiner*—Richard Hjerpe
*Assistant Examiner*—Jennifer T Nguyen
(74) *Attorney, Agent, or Firm*—Staas & Halsey LLP

(57) ABSTRACT

A low power apparatus used in a display device, which cuts off unnecessary power to the display device in the event of abnormal inputs of horizontal and/or vertical synchronous signals. The low power apparatus comprises a synchronous signal checking unit to check whether the inputs of horizontal and vertical synchronous signals are normal or abnormal, and a control unit to respond to the output of the synchronous signal checking unit to decide whether the operational power thereof is supplied or cut off and to detect normal or abnormal inputs of horizontal and vertical synchronous signals to determine whether to reset the synchronous signal checking unit. It is possible to cut off unnecessary power in a DPMS mode so that energy can be saved. Further, effective circuit integrations and cost reductions can be accomplished by reducing the switching devices used in the power stage.

20 Claims, 4 Drawing Sheets

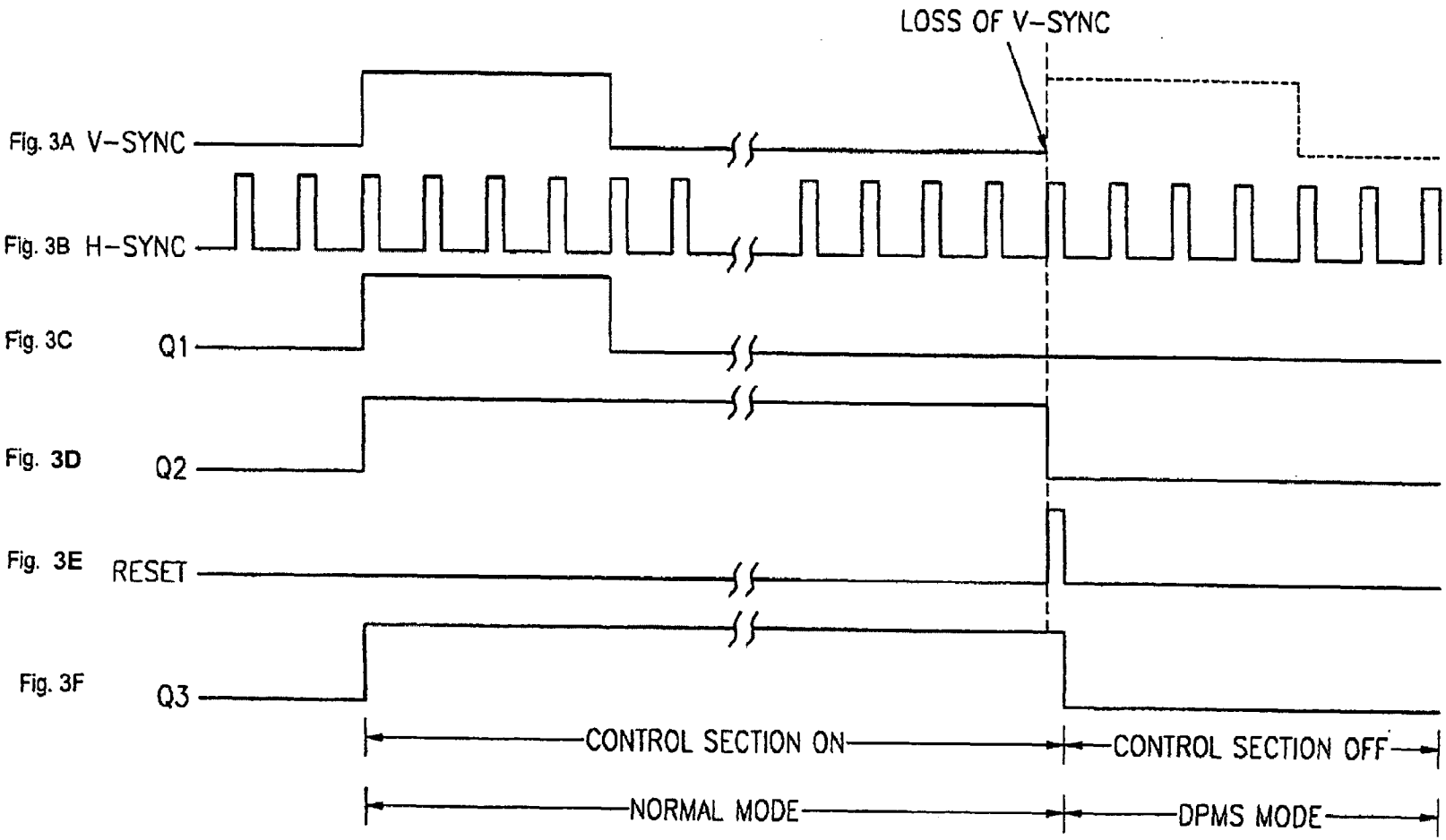
LOSS OF V-SYNC
Fig. 3A V-SYNC
Fig. 3B H-SYNC
Fig. 3C Q1
Fig. 3D Q2
Fig. 3E RESET
Fig. 3F Q3
CONTROL SECTION ON
CONTROL SECTION OFF
NORMAL MODE
DPMS MODE

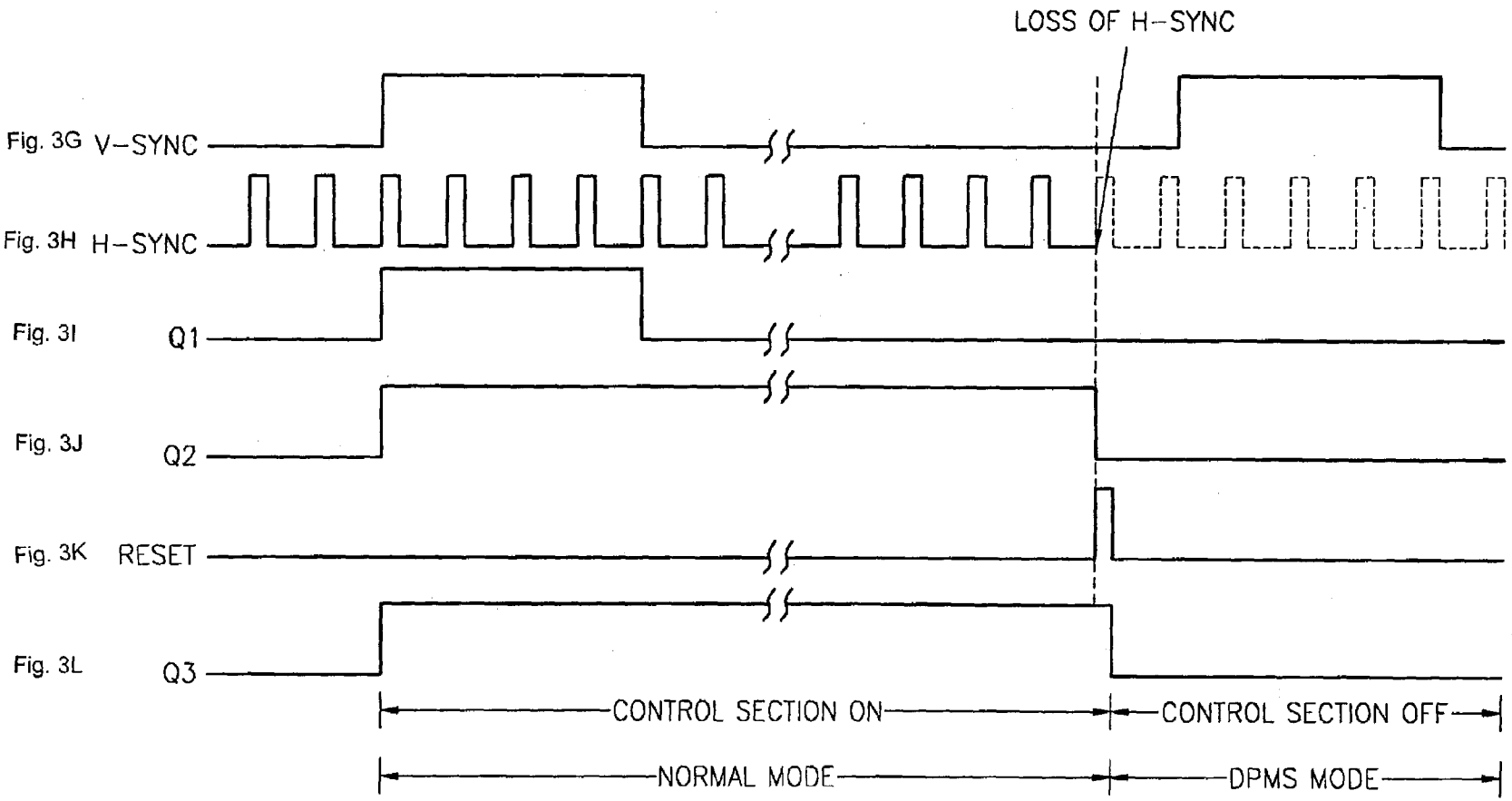
LOSS OF H-SYNC
CONTROL SECTION OFF
DPMS MODE
CONTROL SECTION ON
NORMAL MODE
Fig. 3G V-SYNC
Fig. 3H H-SYNC
Fig. 3I Q1
Fig. 3J Q2
Fig. 3K RESET
Fig. 3L Q3

LOW POWER APPARATUS USED WITH A DISPLAY DEVICE

CROSS-REFERENCE TO RELATED APPLICATIONS

This application claims the benefit of Korean Application No. 2002-55645, filed Sep. 13, 2002, in the Korean Intellectual Property Office, the disclosure of which is incorporated herein by reference.

BACKGROUND OF THE INVENTION

1 . Field of the Invention

The present invention relates to an apparatus to drive display devices and, more particularly, to a low power apparatus used with a display device, which cuts off unnecessary power to the display device in the event of abnormal inputs of horizontal and/or vertical synchronous signals.

2. Description of the Related Art

A schematic configuration of a conventional low power apparatus is shown in FIG. 1. Referring to FIG. 1, a low power apparatus typically comprises a control section 100, a first switching section 101, a second switching section 102, and a display section 103.

The control section 100 continuously checks horizontal and vertical signals H-SYNC and V-SYNC inputted thereto. If the control section 100 detects any abnormality in the input of horizontal and/or vertical synchronous signals, then the control section 100 enters a Display Power Management System (DPMS) mode. In such a DPMS mode, the control section 100 outputs a switching control signal to minimize power consumption by a display device.

The first switching section 101 switches voltage supplies to a first block stage (not shown) that is driven by voltage V1. Likewise, the second switching section 102 switches voltage supplies to a second block stage (not shown) that is driven by voltage V2. The switching control signals for the first and second switching sections 101 and 102 are provided from the control section 100. If the control section 100 detects that the input horizontal and vertical synchronous signals are normal, then the control section 100 provides first and second switching control signals to switch on the first and second switching sections 101 and 102, respectively, so that voltages V1 and V2 are supplied to the first and second block stages, respectively. On the other hand, if the control section 100 detects abnormality in the input horizontal and/or vertical synchronous signals, then the control section 100 recognizes that the display device is in a DPMS mode. In the DPMS mode, the control section 100 provides first and second switching control signals to switch off the first and second switching sections 101 and 102, respectively, so that the supplies of voltages V1 and V2 to the first and second block stages are cut off. The display section 103 typically includes light emitting diode displays that indicate to a user whether the control section 100 is in a normal mode or in a DPMS mode. For example, the display section 103 displays a green light in a normal mode and a blinking amber light in a DPMS mode. The operation of the display section 103 is controlled by the control section 100.

In a conventional configuration as described above, the control section 100 should be in operation all the time, because the control section 100 should continuously detect horizontal and vertical synchronous signals and check whether the display device is in a normal mode or in a DPMS mode. However, a significant amount of power, usually greater than 1 watt, is consumed for the operation of the control section 100 to check whether the display device is in a normal mode or in a DPMS mode, and there has been a limitation to reduce the power consumption to less than 1 watt. Further, since a plurality of switching devices is required to cut off power to multiple block stages, there has been a problem in terms of circuit integration and cost.

SUMMARY OF THE INVENTION

Accordingly, it is an aspect of the present invention to provide a low power apparatus used with a display device, which cuts off unnecessary power to the display device in a DPMS mode, i.e., in the state of abnormality in input horizontal and/or vertical synchronous signals.

Additional aspects and advantages of the invention will be set forth in part in the description which follows and, in part, will be obvious from the description, or may be learned by practice of the invention.

The foregoing and/or other objects of the present invention are achieved by providing a low power apparatus used with a display device, which comprises a synchronous signal checking unit checking whether input horizontal and vertical synchronous signals are normal or abnormal, and a control unit responding to the output of the synchronous signal checking unit to decide whether the operational power of the synchronous signal checking unit is to be supplied or cut off and detecting whether the input horizontal and vertical synchronous signals are normal or abnormal to reset the synchronous signal checking unit.

According to another aspect of the present invention, the low power apparatus further comprises a switching unit receiving the output of the synchronous signal checking unit as a switching control signal to switch the operational power of the control unit.

According to another aspect of the present invention, the above synchronous signal checking unit comprises a first logic circuit which receives a horizontal synchronous signal as its input and a vertical synchronous signal as its clock signal and provides the horizontal synchronous signal as its output, and a second logic circuit which receives a constant voltage as its input and the output of the first logic circuit as its clock signal and provides the constant voltage as its output.

According to another aspect of the present invention, the above second logic circuit provides a switching control signal to cut off the operational power of the control unit in the event that it receives a reset signal from the control unit.

According to another aspect of the present invention, the low power apparatus further comprises a display unit displaying whether the control unit is operating in a normal state or in a low power state in response to the output of the synchronous signal checking unit.

According to another aspect of the present invention, the above display unit comprises a switching section which switches the operation of the display devices, a first logic operator which logically computes the switching signal and the output of the synchronous signal checking unit, a second logic operator which logically computes the inverted switching signal and the output of the synchronous signal checking unit, and a display section which displays the current state of the control section in responding to the outputs of the first and second logic operators.

BRIEF DESCRIPTION OF THE DRAWINGS

These and/or other aspects and advantages of the invention will become apparent and more readily appreciated from the following description of the embodiments, taken in conjunction with the accompanying drawings of which:

FIGS. 3A through 3L show waveforms illustrating the operation of the low power apparatus shown in FIG. 2.

DETAILED DESCRIPTION OF THE INVENTION

Figure 1:
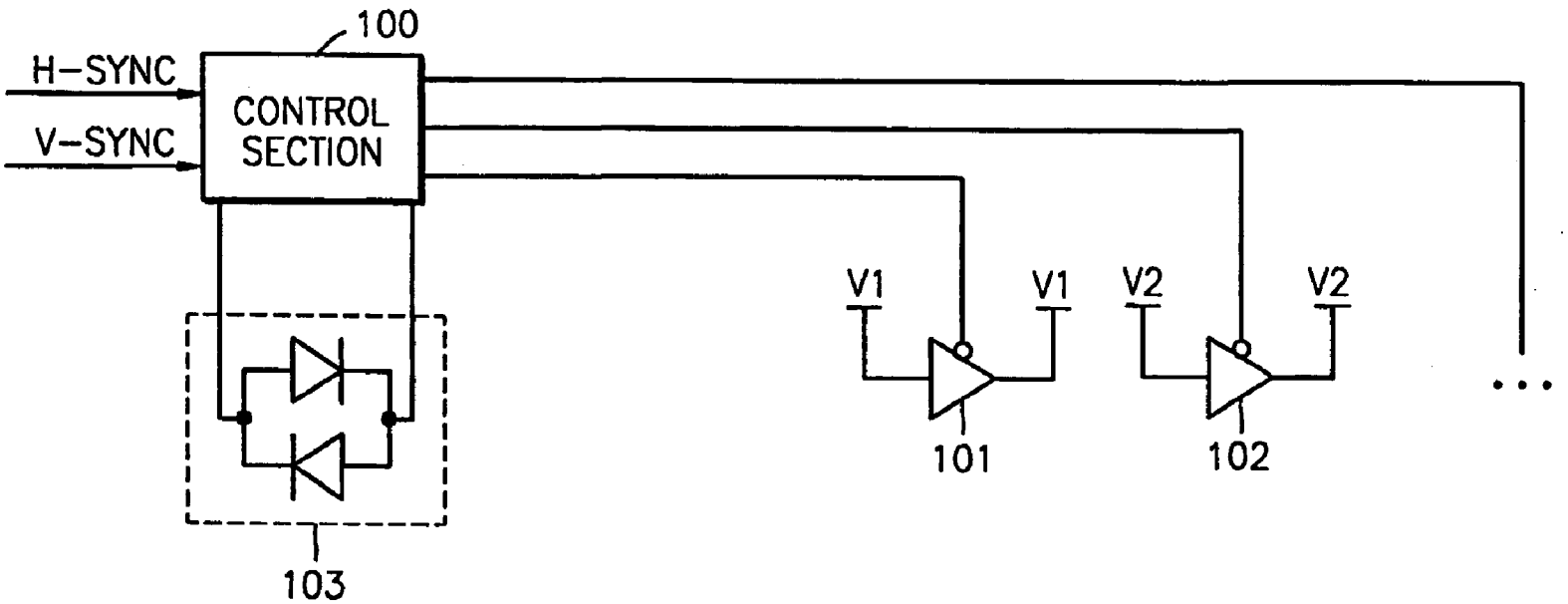
FIG. 1 PRIOR ART
FIG. 1 is a block diagram showing a schematic configuration of a conventional low power apparatus.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 2:
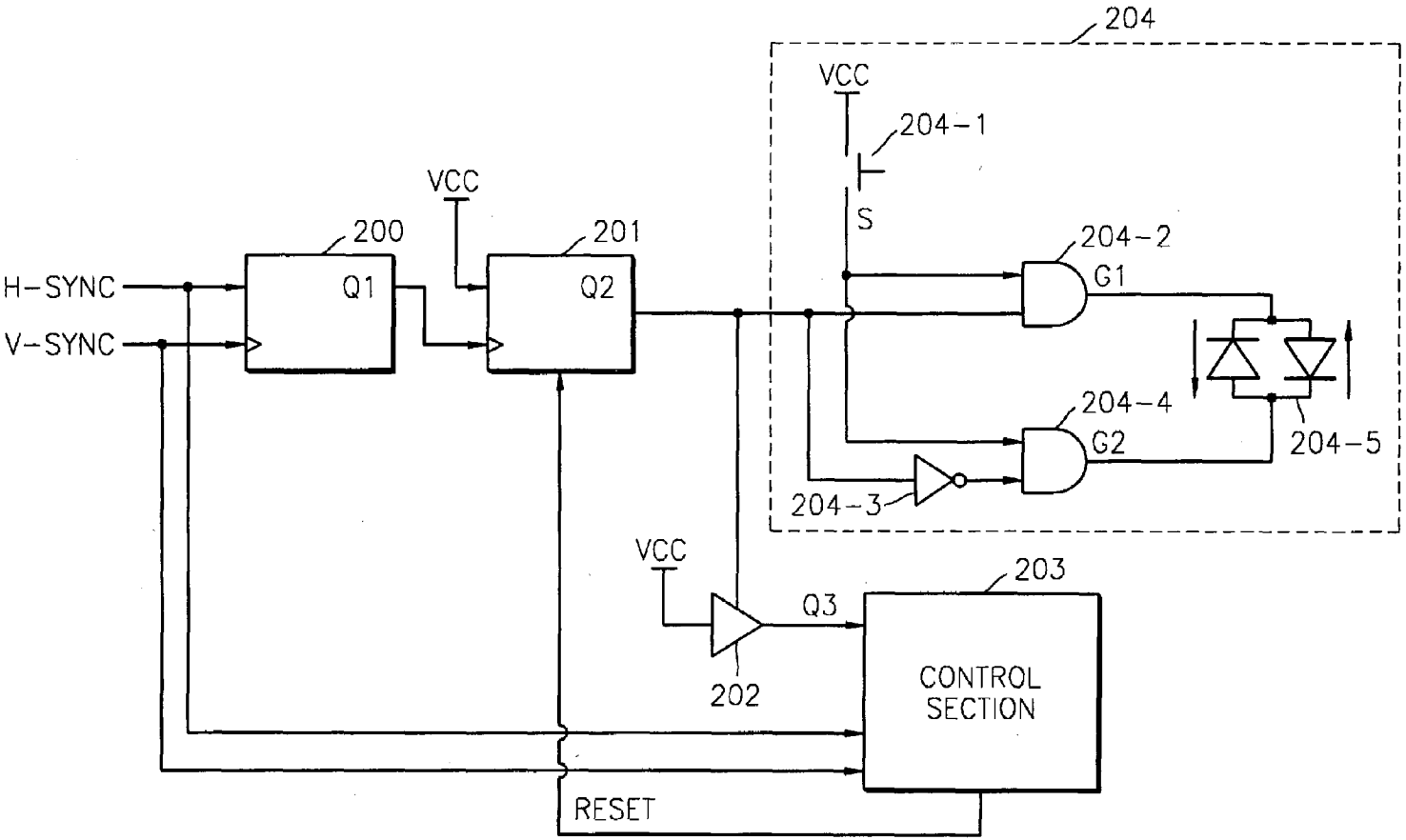
FIG. 2 is a block diagram showing a low power apparatus used with a display device according to an embodiment of the present invention.

An embodiment of a low power apparatus used with a display device according to an embodiment of the present invention is shown as a block diagram in FIG. 2. Referring to FIG. 2, the low power apparatus according to the present invention comprises a first D flip-flop 200, a second D flip-flop 201, a switching section 202, a control section 203, and a display unit 204. In the embodiment of the present invention, the display unit 204 comprises a switch 204-1, a first AND gate 204-2, a NOT gate 204-3, a second AND gate 204-4, and a light emitting diode (LED) indicating section 204-5.

FIGS. 3A through 3L show waveforms illustrating the operation of the low power apparatus shown in FIG. 2. Specifically, FIGS. 3A through 3F show waveforms illustrating the operation of the low power apparatus shown in FIG. 2 in the event that operation is converted from a normal mode to an abnormal mode, i.e. a DPMS mode, due to the loss of a horizontal synchronous signal. On the other hand, FIGS. 3G through 3L show waveforms illustrating the operation of the low power apparatus shown in FIG. 2 in the event that operation is converted from a normal mode to an abnormal mode, i.e. the DPMS mode, due to the loss of a vertical synchronous signal.

Referring back to FIG. 2, the first D flip-flop 200 comprises a logic circuit which utilizes a horizontal synchronous signal as its input and a vertical synchronous signal as its clock signal. In a normal mode when a horizontal synchronous signal is provided as its input and a vertical synchronous signal is provided as its clock signal, the first D flip-flop 200 outputs the horizontal synchronous signal at its output Q1. However, in an abnormal mode, i.e. the DPMS mode, when a horizontal synchronous signal is not provided while a vertical synchronous signal is normally provided, the output Q1 of the first D flip-flop 200 latches the previous state as shown in FIG. 3C. Further, in another abnormal mode, i.e. the DPMS mode, when a vertical synchronous signal is not provided while a horizontal synchronous signal is normally provided, the output Q1 of the first D flop-flop 200 latches the previous state as shown in FIG. 31.

The second D flip-flop 201 comprises a logic circuit which utilizes voltage Vcc as its input and the output signal Q1 of the first D flip-flop 200 as its clock signal. In a normal mode when voltage Vcc is provided as its input and the output signal Q1 of the first D flip-flop 200 is provided as its clock signal, the second D flip-flop 201 provides the voltage Vcc to its output Q2. However, in an abnormal mode, i.e., a DPMS mode, when the output signal Q1 of the first D flip-flop 200 is not provided while the voltage Vcc is normally provided, the output Q2 of the second D flop-flop 201 latches the voltage Vcc of the previous state as shown in FIG. 3D. In another abnormal mode, i.e., a DPMS mode, when the voltage Vcc is not provided to the second D flip-flop 201 while the output signal Q1 of the first D flop-flop 200 is normally provided to the second D flip-flop 201, the output Q2 of the second D flip-flop 201 latches the voltage Vcc of the previous state as shown in FIG. 3J.

As described above, the first and second D flip-flops 200 and 201 function as a synchronous signal checking unit to check whether horizontal and/or vertical synchronous signals are provided normally or abnormally.

The switching section 202 utilizes the output signal Q2 of the second D flip-flop 201 as a switching control signal to determine whether to supply as operational power Q3 or cut off the voltage Vcc to the control section 203. As shown in FIGS. 3D and 3F, or 3J and 3L, respectively, when the output signal Q2 of the second D flip-flop 201 is high, the switching section 202 provides the voltage Vcc to the control section 203 and, accordingly, the control section 203 operates normally. However, when the output signal Q2 of the second D flip-flop 201 is low, the switching section 202 cuts off the voltage Vcc to disable the operation of the control section 203.

The control section 203 detects horizontal and vertical synchronous signals provided thereto and decides whether the low power apparatus will be in a normal mode or a DPMS mode. The control section 203 enters as a normal mode when vertical and horizontal synchronous signals are normally provided. Otherwise, the control section 203 enters as a DPMS mode when vertical and/or horizontal synchronous signals are abnormally provided, for example, due to the loss of either one of or both of vertical and horizontal synchronous signals. In a DPMS mode, the control section 203 provides a reset signal to the second D flip-flop 201 as shown in FIGS. 3E and 3K. When the second D flip-flop 201 is reset, its output Q2 becomes a low state and, accordingly, the switching section 202 cuts off the voltage Vcc to the control section 203 . Since the power to the control section 203 is cut off in a DPMS mode, the control section 203 stops operating as shown in FIGS. 3F and 3L. Thereafter, when the horizontal and/or vertical synchronous signals are normally provided again, the output of the second D flip-flop 201 becomes high and, accordingly, the switching section 202 provides the voltage Vcc to the control section 203 as operational power Q3 so that the control section 203 starts to operate again.

The display unit 204 displays the operational states of the control section 203. Specifically, the display unit 204 displays the operational states of the control section 203 in responding to the output Q2 of the second D flip-flop 201 and the switching results of a switch 204-1 to the voltage Vcc. If the output Q2 of the second D flip-flop 201 is high in a normal mode of the control section 203 and the voltage Vcc is provided in an on state of the switch 204-1, the output of the first AND gate 204-2 becomes high and the output of the second AND gate 204-4 becomes low. In this normal mode, the current through the LED indicating section 204-5 flows in a downward direction in FIG. 2, to enable the LED to display the normal mode. On the other hand, if the output Q2 of the second D flip-flop 201 is low in a DPMS mode of the control section 203 and the voltage Vcc is provided in an on state of the switch 204-1, the output of the first AND gate 204-2 becomes low and the output of the second AND gate 204-2 becomes high. In this DPMS mode, the current through the LED indicating section 204-5 flows in an upward direction in FIG. 2, to enable the LED to display the DPMS mode.

If the output Q2 of the second D flip-flop 201 is high in a normal mode of the control section 203 and the voltage Vcc is not provided in an off state of the switch 204-1, the output of the first AND gate 204-2 becomes low and the output of the second AND gate 204-4 becomes low. Accordingly, no current flows through the LED indicating section 204-5, and the LED provides no display. On the other hand, if the output Q2 of the second D flip-flop 201 is low in a DPMS mode of the control section 203 and the voltage Vcc is not provided in an off state of the switch 204-1, the output of the first AND gate 204-2 becomes low and the output of the second AND gate 204-4 becomes low. Accordingly, there are no current flows through the LED indicating section 204-5, and the LED provides no display.

Table 1 provided below represents the operational states of the LED indicating section 204-5 according to the states of the control section 203. It is noted that the LED indicating section 204-5 shown in FIG. 2 operates identically even when horizontal and vertical synchronous signals have opposite polarities.

TABLE 1

| S | Q2 | G1 | G2 | LED Current Direction |
|---|---|---|---|---|
| ON | H | H | L | Downward |
| ON | L | L | H | Upward |
| OFF | H | L | L | Off |
| OFF | L | L | L | Off |

According to the present invention, it is possible to cut off unnecessary power in a DPMS mode as described above so that energy can be saved. Further, effective circuit integration and cost reduction could be accomplished by reducing the number of switching devices used in the power stage.

In one embodiment, the present invention comprises a low power apparatus used with a display device, comprising: a synchronous signal checking unit checking whether input horizontal and vertical synchronous signals are normal or abnormal; a control unit receiving the output of said synchronous signal checking unit to decide whether operational power of the control unit is supplied or cut off and to detect normal or abnormal inputs of the horizontal and vertical synchronous signals to determine whether to reset said synchronous signal checking unit; and a display unit displaying whether said control unit is operating in a normal state or in a low power state in response to the output of said synchronous signal checking unit, wherein said display unit comprises: a switching section switching the operation of said display device; a first logic operator logically computing said switching signal and the output of said synchronous signal checking unit; a second logic operator logically computing an inverted signal of said switching signal and the output of said synchronous signal checking unit; and a display section displaying the current state of said control section in response to the outputs of said first and second logic operators.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A low power apparatus, comprising:

a synchronous signal checking unit checking whether input horizontal and/or vertical synchronous signals are normal or abnormal; and a control unit receiving an output of said synchronous signal checking unit to decide whether operational power of the control unit is supplied or cut off and to detect normal or abnormal inputs of the input horizontal and/or vertical synchronous signals to determine whether to reset said synchronous signal checking unit, wherein said synchronous signal checking unit comprises:

a first logic circuit receiving the horizontal synchronous signal as an input and the vertical synchronous signal as a clock signal, to provide the horizontal synchronous signal as an output; and a second logic circuit receiving a constant voltage as an input and the output of the first logic circuit as a clock signal, to provide the constant voltage as an output.

2. The low power apparatus according to claim 1, wherein said second logic circuit provides a switching control signal to switch the operational power to said control unit after receiving a reset signal from said control unit and receiving normal inputs of the horizontal and vertical synchronous signals.

3. The low power apparatus according to claim 2, wherein in an abnormal mode, when the output signal of the first logic circuit is not provided while the constant voltage as an input is provided, the output of the second logic circuit latches the input voltage of a previous state.

4. The low power apparatus according to claim 2, wherein in an abnormal mode, when the constant input voltage is not provided to the second logic circuit while the output signal of the first logic circuit is provided to the second logic circuit, the output of the second logic circuit latches the constant input voltage of a previous state.

5. The low power apparatus according to claim 1, wherein in an abnormal mode, when the horizontal synchronous signal is not provided while the vertical synchronous signal is provided, the output of the first logic circuit latches a previous state.

6. The low power apparatus according to claim 1, wherein in an abnormal mode, when the vertical synchronous signal is not provided while the horizontal synchronous signal is provided, the output of the first logic circuit latches a previous state.

7. The low power apparatus according to claim 1, wherein the first logic circuit includes a flip-flop and the second logic circuit includes a flip-flop.

8. The low power apparatus according to claim 1, wherein the switching unit comprises an operational amplifier.

9. The low power apparatus according to claim 1, further comprising:

a switching unit receiving the output of said synchronous signal checking unit as a switching control signal to switch the operational power of said control unit; and an indication unit receiving the same output of said synchronous signal checking unit as received by the switching unit and indicating by a luminous element whether said control unit is operating in a normal state or in a low power state in response to the output of said synchronous signal checking unit.

10. A low power apparatus, comprising:

a synchronous signal checking unit checking whether input horizontal and/or vertical synchronous signals are normal or abnormal;

a control unit receiving an output of said synchronous signal checking unit to decide whether operational power of the control unit is supplied or cut off and to detect normal or abnormal inputs of the input horizontal and/or vertical synchronous signals to determine whether to reset said synchronous signal checking unit; and an indication unit indicating by a luminous element whether said control unit is operating in a normal state or in a low power state in response to the output of said synchronous signal checking unit, wherein said synchronous signal checking unit comprises:

a first logic circuit receiving the horizontal synchronous signal as an input and the vertical synchronous signal as a clock signal, to provide the horizontal synchronous signal as an output; and a second logic circuit receiving a constant voltage as an input and the output of the first logic circuit as a clock signal, to provide the constant voltage as an output.

11. A low power apparatus, comprising:

a synchronous signal checking unit checking whether input horizontal and vertical synchronous signals are normal or abnormal;

a control unit receiving the output of said synchronous signal checking unit to decide whether operational power of the control unit is supplied or cut off and to detect normal or abnormal inputs of the horizontal and vertical synchronous signals to determine whether to reset said synchronous signal checking unit; and an indication unit, wherein said indication unit comprises:

a switching section switching operation of said display device;

a first logic operator logically computing said switching signal and the output of said synchronous signal checking unit;

a second logic operator logically computing an inverted signal of said switching signal and the output of said synchronous signal checking unit; and a luminous element indicating a current state of said control section in response to outputs of said first and second logic operators.

12. The low power apparatus according to claim 11, wherein the first logic operator comprises an AND gate and the second logic operator comprises an AND gate.

13. The low power apparatus according to claim 11, wherein the indicating section comprises an LED display receiving the outputs of the first logic operator and the second logic operator.

14. A low power apparatus, comprising:

a synchronous signal checking portion checking whether input horizontal and/or vertical synchronous signals are normal or abnormal;

a control portion receiving an output of said synchronous signal checking portion to determine whether operational power of the control portion is supplied or cut off and to detect normal or abnormal inputs of the input horizontal and/or vertical synchronous signals to determine whether to reset said synchronous signal checking portion;

a feedback from said control portion to said synchronous signal checking portion to supply a reset signal to the synchronous signal checking portion when the vertical and/or horizontal signals are abnormally provided to the synchronous signal checking portion; and an indication unit indicating by a luminous element whether said control portion is operating in a normal state or in a low power state in response to the output of said synchronous signal checking portions, wherein said synchronous signal checking unit comprises:

a first logic circuit receiving the horizontal synchronous signal as an input and the vertical synchronous signal as a clock signal, to provide the horizontal synchronous signal as an output; and a second logic circuit receiving a constant voltage as an input and the output of the first logic circuit as a clock signal, to provide the constant voltage as an output.

15. A low power apparatus for a display device, the low power apparatus comprising:

a control unit detecting horizontal and/or vertical synchronous signals to determine whether a present state is a normal state or power save state;

a power unit supplying or cutting off operation power supplied to the control unit according to the input state of the horizontal and/or vertical synchronous signals;

a switching section generating a switching signal to turn on or off the power unit;

an indication unit to indicate the normal state or a DPMS state; and a synchronous signal checking unit checking an input state of the horizontal and/or vertical synchronous signals, wherein the indication unit comprises:

a first logic operator performing a logic operation of the switching signal and an output of the synchronous signal check unit; and a second logic operator performing a logic operation of a reversed switching signal and an output of the synchronous signal check unit, and wherein the indication unit indicates the present state of the control unit using an output of the first logic operator and an output of the second logic operator.

16. The low power apparatus according to claim 15, wherein the indication unit comprises an LED (light emitting diode) to indicate an operation state of the control portion according to output of the switching section and the input state of the horizontal and/or vertical synchronous signals.

17. The low power apparatus according to claim 15, wherein the switching section cuts off the operation power of the control unit when the input state of horizontal and/or vertical synchronous signals is abnormal.

18. The low power apparatus according to claim 15, wherein the abnormal input state of the horizontal and/or vertical synchronous signals is a state in which the horizontal and/or vertical synchronous signals are not input.

19. A method for operating a display device, the method comprising:

utilizing a synchronous signal checking unit comprising a first logic circuit receiving a horizontal synchronous signal as an input and a vertical synchronous signal as a clock signal, to provide the horizontal synchronous signal as an output and a second logic circuit receiving a constant voltage as an input and the output of the first logic circuit as a clock signal, to provide a constant voltage as an output;

detecting outputs of the horizontal and vertical synchronous signals through a control unit;

determining the display device in a normal state when the outputs of the horizontal and/or vertical synchronous signals are normally input;

determining the display device in a DPMS state when the outputs of the horizontal and/or vertical synchronous signals are abnormally input;

when the operation state of the display device is determined in the normal state, the control unit receives operation power, and when the operation state of the display device is determined in the DPMS state, the control unit cuts off the operation power; and indicating the normal state or DPMS state of the control unit using an LED.

20. The method according to claim 19, wherein the abnormal input state of the horizontal and/or vertical synchronous signals is a state in which the horizontal and/or vertical synchronous signals are not input.

* * * * *

UNITED STATES PATENT AND TRADEMARK OFFICE

CERTIFICATE OF CORRECTION

PATENT NO. : 7,277,093 B2
APPLICATION NO. : 10/361637
DATED : October 2, 2007
INVENTOR(S) : Gi-soo Kim It is certified that error appears in the above-identified patent and that said Letters Patent is hereby corrected as shown below:

Column 8, Line 2, change “portions,” to --portion,--.

Signed and Sealed this

Eighth Day of April, 2008

JON W. DUDAS
*Director of the United States Patent and Trademark Office*